US009708887B2

(12) United States Patent
Luke

(10) Patent No.: US 9,708,887 B2
(45) Date of Patent: Jul. 18, 2017

(54) BALL SEAT FOR USE IN A WELLBORE

(71) Applicant: Weatherford Technology Holdings, LLC, Houston, TX (US)

(72) Inventor: Mike A. Luke, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 219 days.

(21) Appl. No.: 14/704,578

(22) Filed: May 5, 2015

(65) Prior Publication Data

US 2016/0326833 A1 Nov. 10, 2016

(51) Int. Cl.

| | |
|---|---|
| ***E21B 34/06*** | (2006.01) |
| ***E21B 34/08*** | (2006.01) |
| ***E21B 33/12*** | (2006.01) |

(52) U.S. Cl.

CPC ..... *E21B 34/06* (2013.01); *E21B 33/12* (2013.01); *E21B 34/08* (2013.01)

(58) Field of Classification Search

CPC ..... E21B 34/06; E21B 33/12; E21B 34/08

See application file for complete search history.

(56) References Cited

U.S. PATENT DOCUMENTS 5,558,153 A 9/1996 Holcombe et al.
2011/0232917 A1* 9/2011 Skinner ..... E21B 21/10 166/373
2013/0118732 A1 5/2013 Chauffe et al.
2014/0014360 A1 1/2014 Wilson

FOREIGN PATENT DOCUMENTS

| | | | | |
|---|---|---|---|---|
| EP | 2725188 | * | 4/2014 | ..... E21B 43/04 |
| EP | 2725188 | A2 | 4/2014 | |
| GB | 2294486 | A | 5/1996 | |
| WO | 2014193405 | A1 | 12/2014 | |

OTHER PUBLICATIONS

PCT International Search Report and Written Opinion dated May 27, 2016, for International Application No. PCT/US2016/024036.

* cited by examiner

*Primary Examiner* — Yong-Suk (Philip) Ro
(74) *Attorney, Agent, or Firm* — Patterson & Sheridan, L.L.P.

(57) ABSTRACT

A downhole device shifts a component from a first state to a second state. The device includes a body having the component in a bore thereof and an annular space formed within an inner and outer wall of the body. The annular space includes a first fluid chamber in fluid communication with the bore at a first location and with a pressure transducer at a second location, the transducer constructed and arranged to measure pressure of the fluid and provide a signal to circuitry controlling a valve upon reception of a predetermined fluid pressure pulse sequence. When the pulse sequence is delivered, the valve opens, placing a source of pressurized fluid in communication with an actuator that shifts the valve.

17 Claims, 10 Drawing Sheets

BALL SEAT FOR USE IN A WELLBORE

BACKGROUND OF THE INVENTION

Field of the Invention

Embodiments of the present invention generally relate to a method and apparatus for temporarily sealing a bore of a tool. More particularly, the invention relates to a ball seat and a method and apparatus for remotely releasing the ball.

Description of the Related Art

In the completion and operation of a hydrocarbon well, it is often necessary to remotely actuate a downhole tool in order to move the tool from a first to a second state. In one example, a packer is run into the well on a string of tubulars and then actuated, thereby causing sealing members to extend radially outwards into sealing contact with walls of the wellbore. One way of remotely actuating the tool is through a temporary increase in fluid pressure adequate to shift a piston formed on the tool that in turn causes the sealing members to move. In order to increase pressure in the area of the tool, the wellbore is typically blocked at a location below the tool. In one instance, the wellbore is blocked with a ball and ball seat. In one example, a ball is dropped from the surface of the well into the ball seat. With the bore blocked, pressure is increased to a point that sets the tool. Thereafter, pressure is increased to a higher level in order to "blow out " the ball seat, permitting the ball to fall through the seat and the bore to be re-opened. While the forgoing arrangement is operable, it necessarily requires high pressures, especially to blow out the ball seat. High pressure can damage hydrocarbon-bearing formations through shock loading due to pressure surge or water hammer effect.

There is a need therefore, for a ball and seat arrangement wherein the ball can be released from the seat without the use of a fluid pressure differential across the seat.

SUMMARY OF THE INVENTION

The present invention generally relates to a downhole device for shifting a component from a first state to a second state. In one embodiment, the device includes a body having the component in a bore thereof and an annular space formed within an inner and outer wall of the body. The annular space includes a first fluid chamber in fluid communication with the bore at a first location and with a pressure transducer at a second location, the transducer constructed and arranged to measure pressure of the fluid and provide a signal to circuitry controlling a valve upon reception of a predetermined pressure pulse sequence. When the pulse sequence is delivered, the valve opens, placing a source of pressurized fluid in communication with an actuator that shifts the valve.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The present invention relates to a downhole tool for temporarily blocking and un-blocking a flow path through a wellbore. More particularly, the invention relates to a ball and ball seat wherein the ball can be released from the seat without the use of a pressure differential across the seat.

Figure 1:
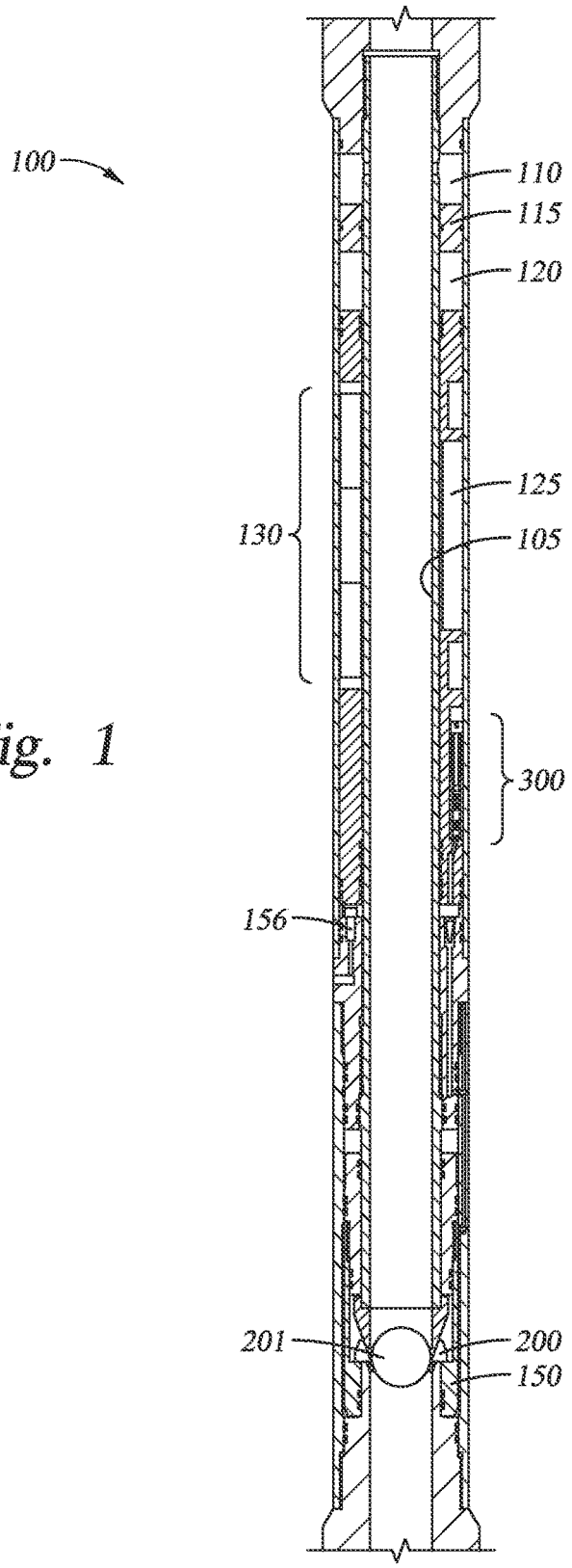
FIG. 1 is a cross section view of a tool according to one embodiment of the invention.

FIG. 1 is a cross section view of a tool 100 according to one embodiment of the invention. The tool is constructed and arranged to be installed in a tubular string, typically production string (not shown) and is provided with threaded connections at an upper and lower ends. As shown, the tool includes a central bore 105, the bore including a ball seat 200, shown in a reduced diameter position with a ball 201 therein. In the position of FIG. 1, the ball and ball seat are configured to block the bore 105 of the tool 100 and permit pressure to be developed in the wellbore at any location above the tool. Another tool needing pressure actuation would typically be disposed in the tubular string at a location above the tool 100. The tool is constructed with an annular space formed between an inner 101 and outer 102 walls and in one embodiment of the invention; components are housed in the annular space. The various components are shown in greater detail in other Figures but the primary portions include a wellbore fluid chamber 110, an annular piston 115, a hydraulic fluid chamber 120, electronic circuitry 125 and batteries 130. Additionally, a number of interconnected fluid paths are formed in the annular space as well as a valve assembly 300 with a valve that is remotely openable to expose pressurized fluid in the fluid paths to an annular piston 150 that shifts the ball seat 200 to its larger diameter position in order to release the ball 201 and un-block the bore 105.

Figure 2:
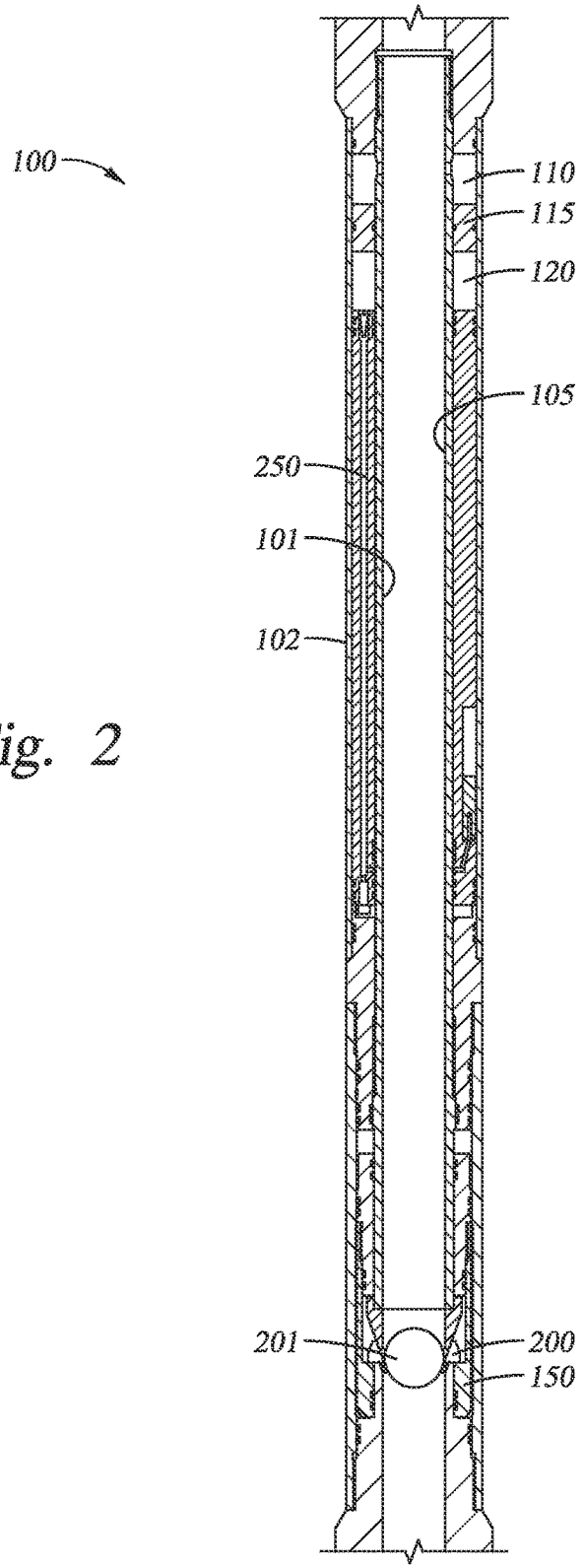
FIG. 2 is a cross section view of the tool of FIG. 1 shown in a different rotational position.
Figure 3:
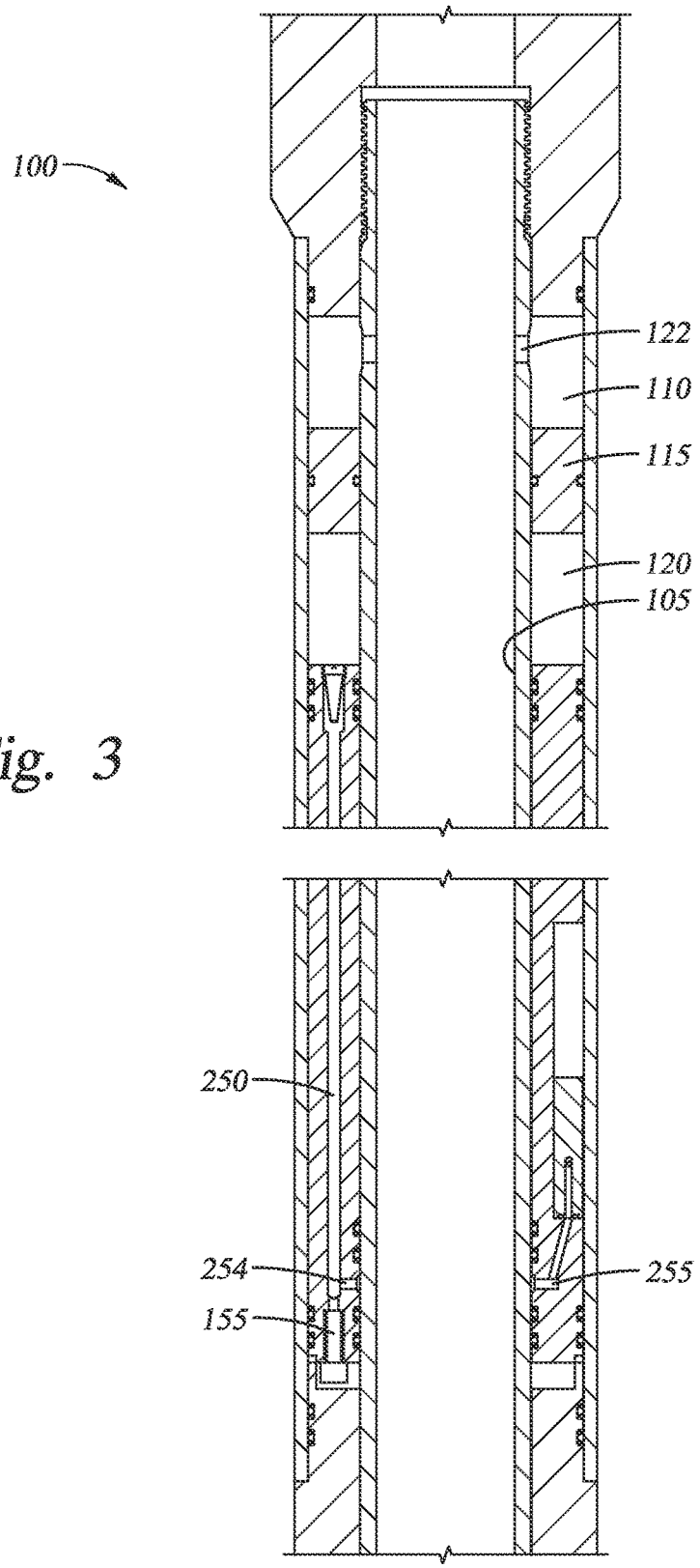
FIG. 3 is a cross section view showing two portions of the tool in greater detail.

FIG. 2 is a cross section view of the tool of FIG. 1 shown in a different rotational position and illustrates a first fluid path 250 (shown on the left side of the annular space) in greater detail. FIG. 3 is a cross section view showing two portions of the tool 100 in greater detail. In particular, the upper portion of the Figure illustrates an aperture 122 leading from the bore 105 of the tool to the annular wellbore fluid chamber 110. The aperture 122 permits fluid pressure communication between the bore and the first fluid path 250 disposed in the annular area of the tool. As will be shown, the pressure of the fluid in the bore, and with it the pressure in the annular chambers 110, 120 can be increased or decreased and delivered in pulses. A predetermined delivery of such pulses can be used to open the valve and ultimately shift the ball seat 200 from the smaller diameter position of FIG. 1 to a larger diameter position. Wellbore fluid chamber 110 is separated from hydraulic fluid chamber 120 by an annular piston 115 in order to prevent contamination of the hydraulic fluid while allowing it to be effected by pressure and pulses from the bore of the tool. The first fluid path 250 extends from the hydraulic fluid chamber 120 to a tubing pressure transducer 155 that is placed in the fluid path 250 where it receives and measures pressures and pulses in the bore of the tool as well as timing associated with those pressures and pulses and then generates an electrical signal based upon those values to circuitry 125 disposed in an adjacent area of the annular space (FIG. 1). The first fluid path 250 is connected to a second fluid path 252 extending from one side of the annular space to the other. Located just above the tubing pressure transducer 155 on the left side of the Figure is a port 254 that leads into the second fluid path 252 around the annular body terminating at another port 255 visible on the right side of the Figure. Port 255, in turn is connected to a third fluid path 256 that leads to the valve assembly 300 not visible in FIG. 3 but visible in FIG. 4.

Figure 4:
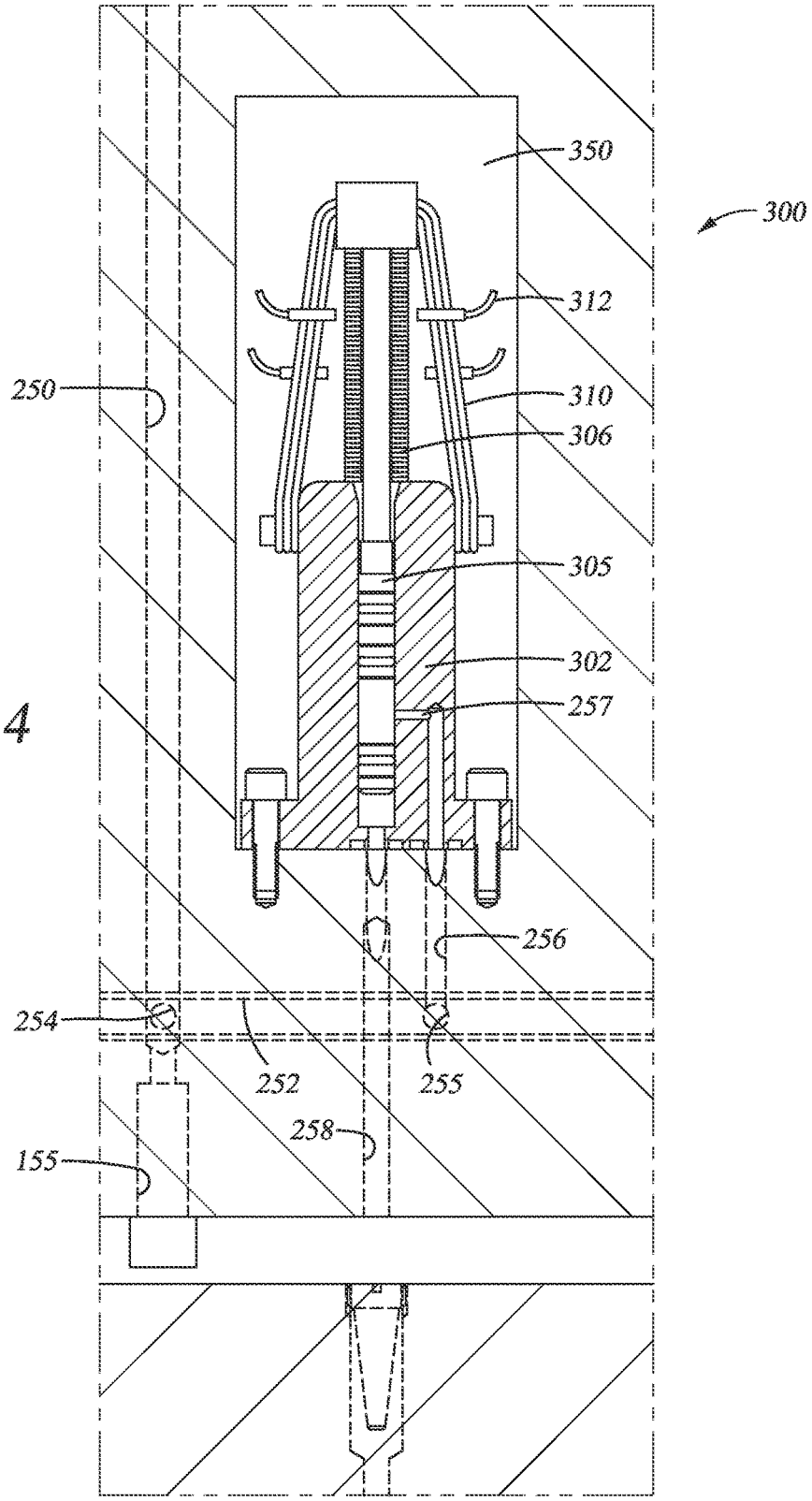
FIG. 4 is a cross section view showing a valve assembly with a valve shown in a closed position.

FIG. 4 is a cross section view showing the valve assembly 300 with a valve 302 shown in a closed position. As shown, the third fluid path 256 leads to the valve. In the embodiment shown, the valve assembly 300 includes a Kevlar fuse 350 which is designed to operate based upon an electronic signal from the on-board circuitry 125 in the tool 100. The valve 302 includes a plunger 305 which in the closed position, blocks a fluid path through the valve 302 that otherwise connects the third fluid path entering the valve with a fourth fluid path 258 leading from valve. The plunger 305 is biased towards an open position due to a spring 306 but is initially held in a closed position, against the force of the compressed spring by retaining members 310 that are equipped with electrodes (partially shown) 312 causing them to fail in the event of a predetermined electrical signal from the circuitry 125. One example of a Kevlar fuse-type device is shown and described in U.S. Pat. No. 5,558,153 and that patent is incorporated by reference in its entirety herein.

Figure 5:
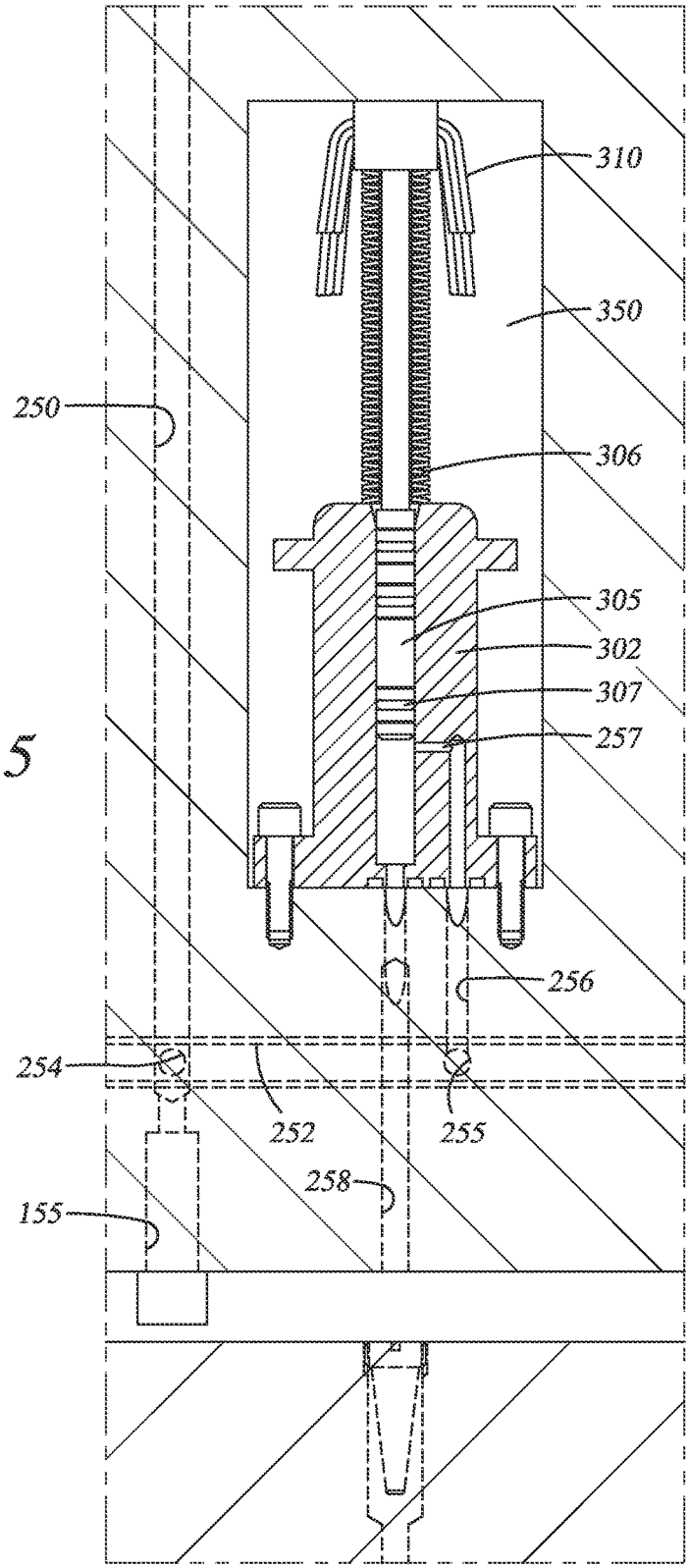
FIG. 5 is a cross section view showing the valve in an open position.
Figure 6:
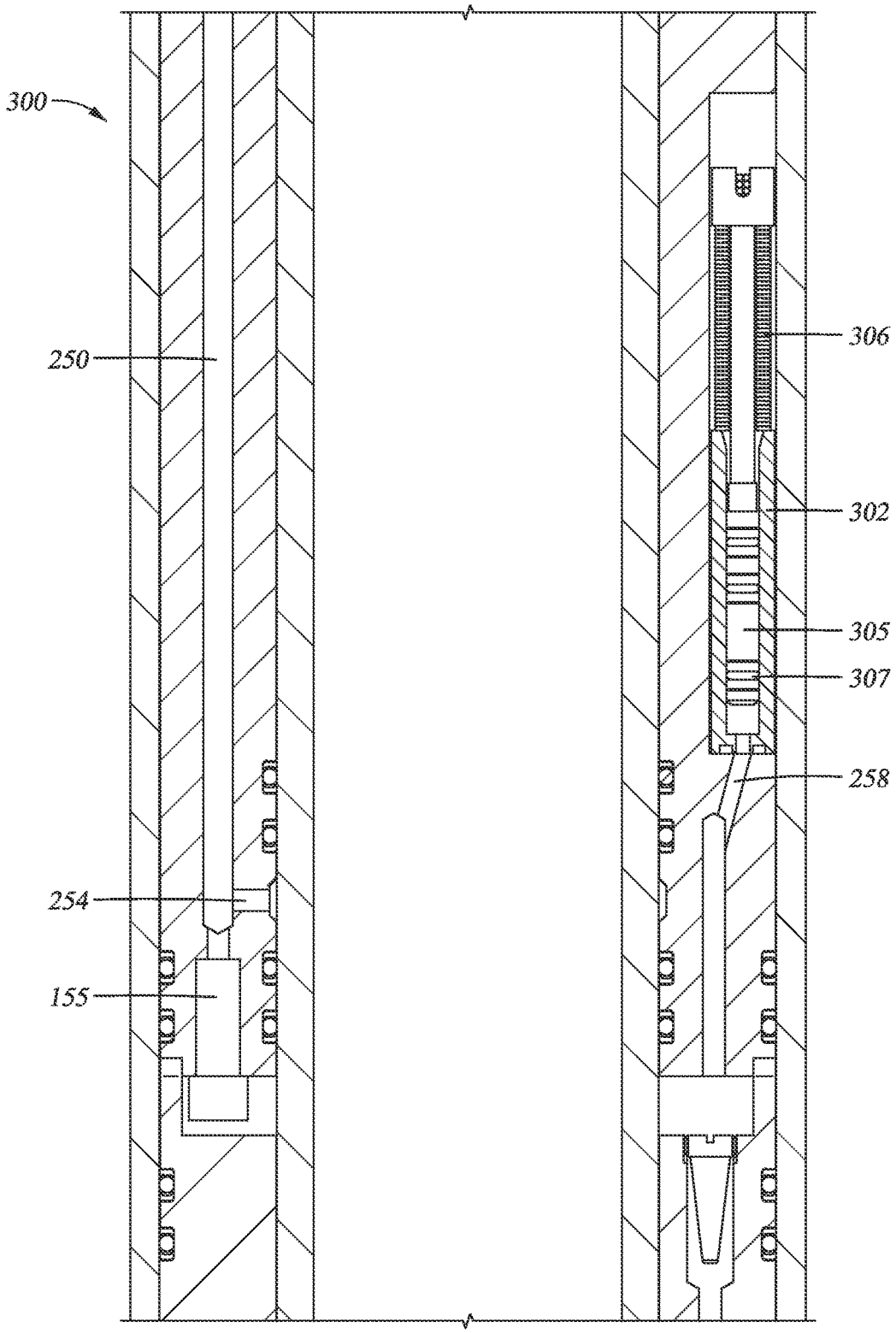
FIGS. 6 and 7 are section views of the valve in a different rotational position, shown in the open and closed positions, respectively.
Figure 7:
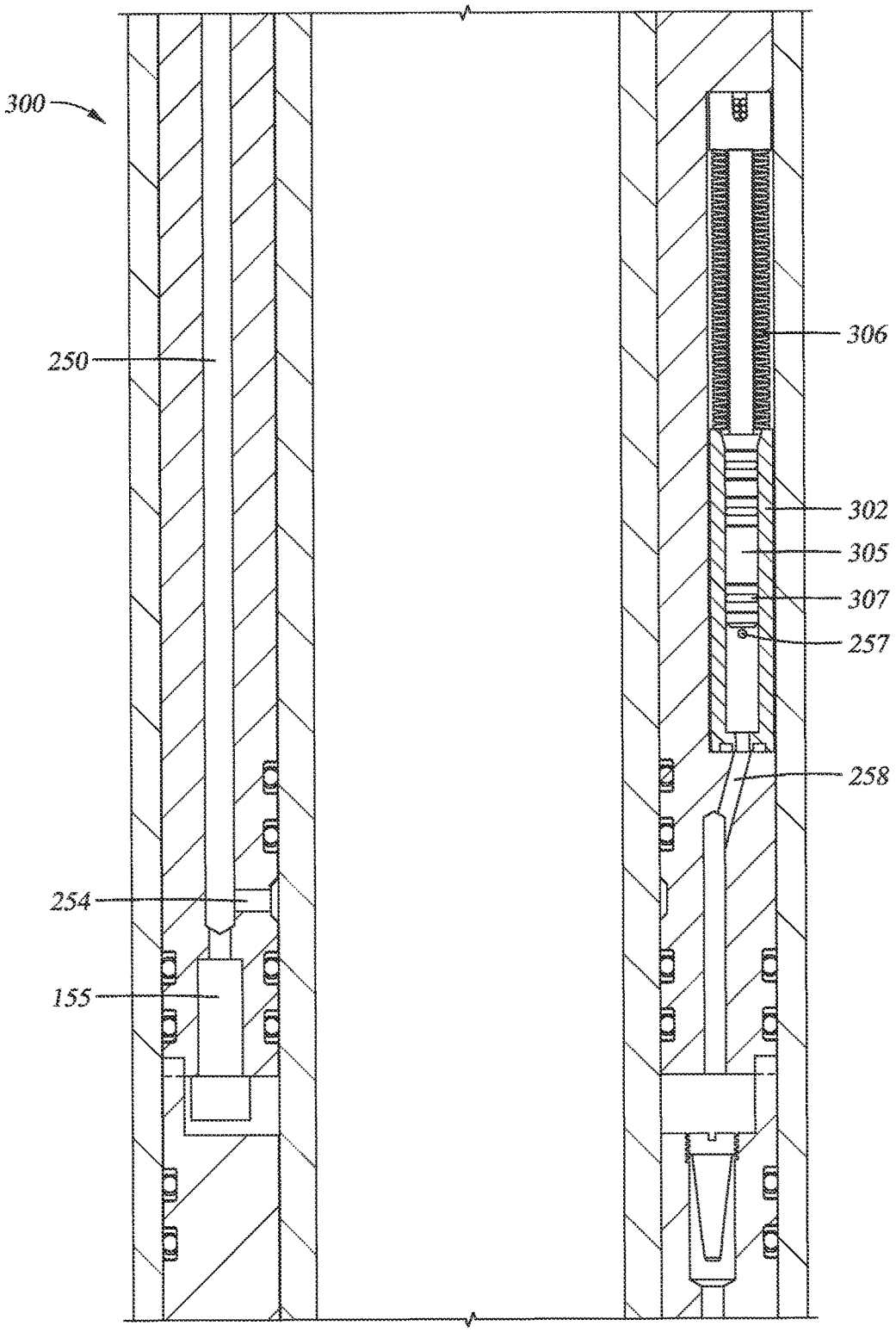

FIG. 5 is a cross section view showing the valve 302 in an open position. As shown, the retaining members 310 have been caused to fail and the plunger 305 has been moved from a first closed position (FIG. 4), in which port 257 is blocked by the plunger 305, to an second, open position (FIG. 5) wherein fluid traveling in port 257 is free to enter and pass through the valve due to the extended spring 306 which was initially held in a compressed position. FIGS. 6 and 7 are section views of the valve assembly 300 from a different rotational position, shown in the open and closed positions, respectively. Visible in each is the valve 302 with its plunger 305 biased by the spring 306. In FIG. 6 the port 257 (not shown) leading into the valve is blocked by a plunger member 307. In FIG. 7 however, port 257 is visible and the fluid therein is in communication with the fourth fluid path 258 leading out of the valve.

Figure 8:
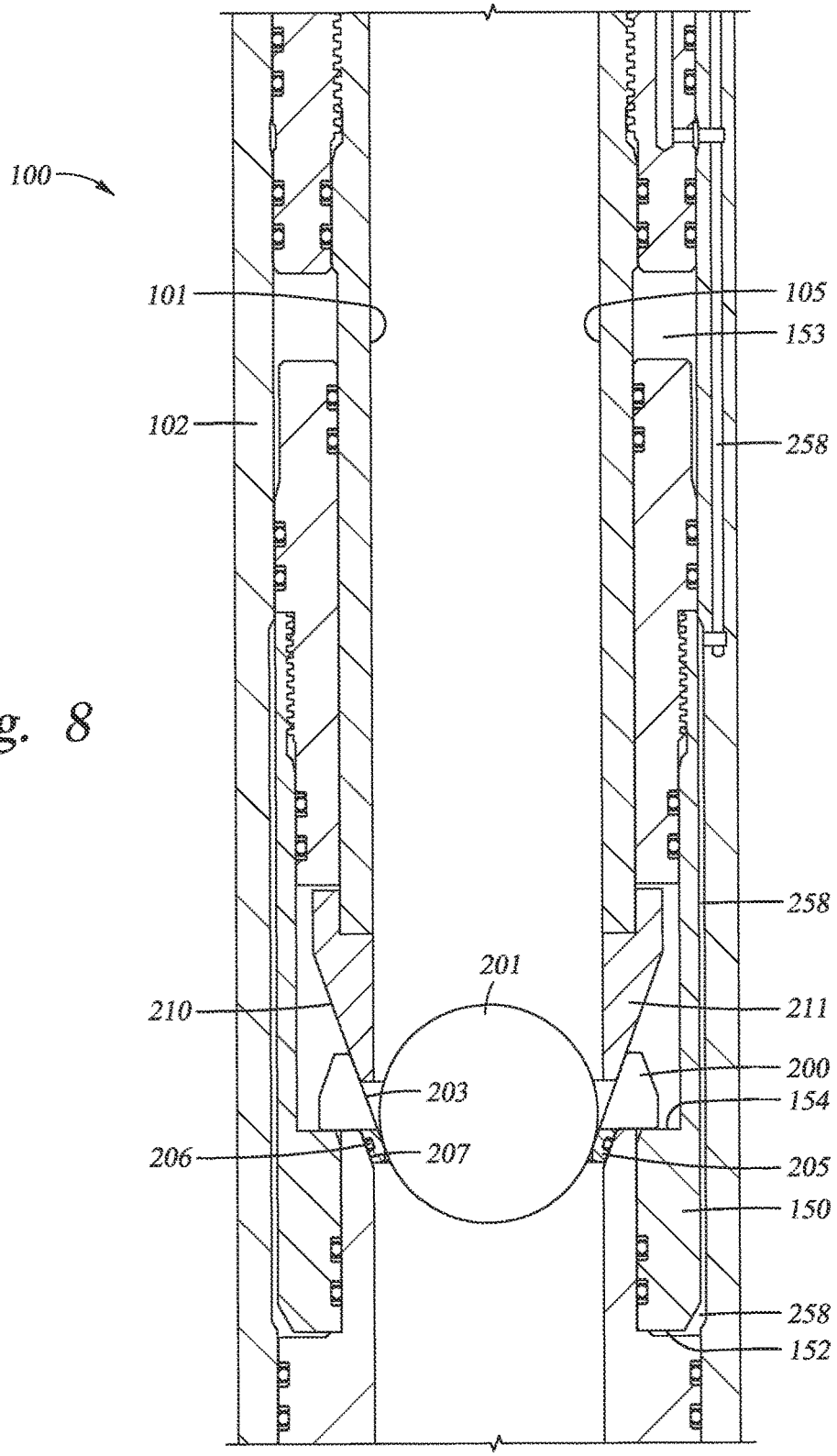
FIG. 8 is a cross section view showing a lower portion of the tool including a ball seat with a ball held therein.
Figure 9A:
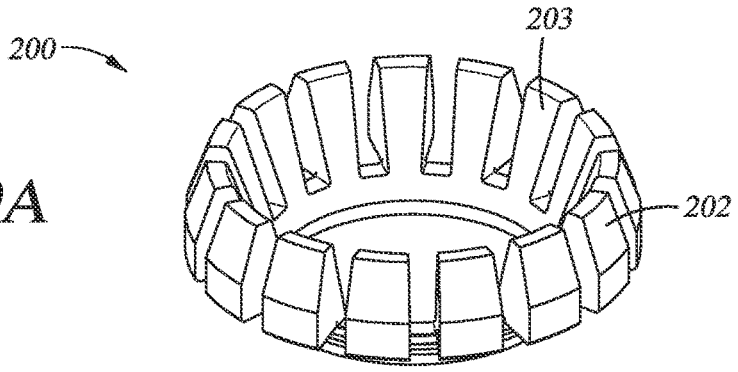
FIGS. 9 A-D are perspective views of the ball seat.
Figure 9B:
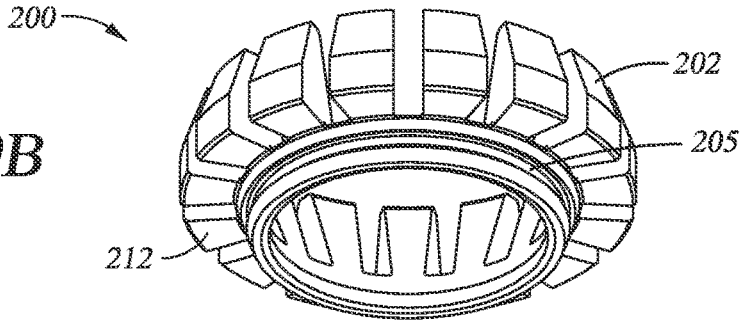
Figure 9C:
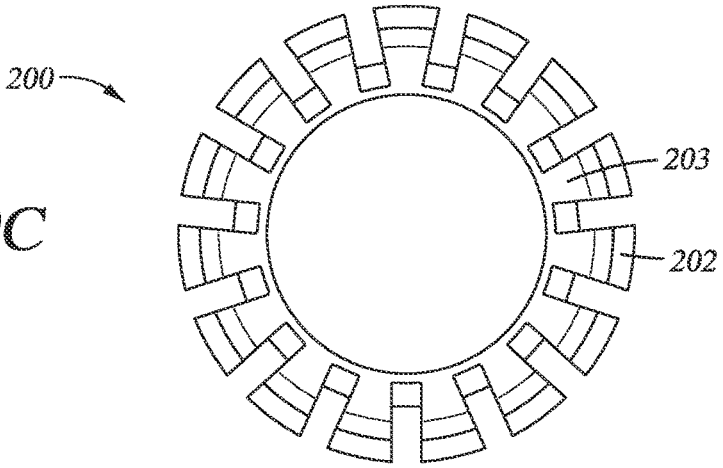
Figure 9D:
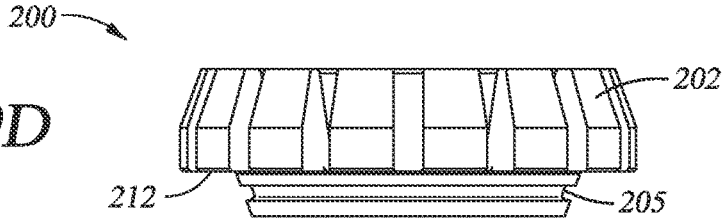

FIG. 8 is a cross section view showing a lower portion of the tool 100 including ball seat 200 with ball 201 held therein. The ball seat is constructed of a plurality of castellations 202, equally spaced around a perimeter of a sealing ring 205 and more completely illustrated in FIGS. 9 A-D, which include various perspective views of the ball seat 200. Each castellation 202 has an angled inner surface 203 and is mounted at a lower end to a sealing ring 205. The ring 205 includes at least one O-ring (visible in FIGS. 8, 10) for sealing against an upwardly facing shoulder 207 formed in the body of the tool and constructed and arranged to retain and seal the ball seat 200 in the bore 105 of the tool 100. The purpose of the angled inner surface 203 of each castellation 202 is to mate with and move upwards relative to a conical surface 210 formed on an outer diameter of a sleeve 211 installed in the bore 105 of the tool above the ball seat 200. Visible in FIG. 8 is an annular shifting piston 150 with a piston surface 152 formed on a lower end thereof and in communication with the lower end of fourth fluid path 258 extending from the valve 302 (when the valve is open). A space 153 above the piston 150 is filled with air at atmospheric pressure permitting the gap to be reduced in volume as the piston moves.

Figure 10:
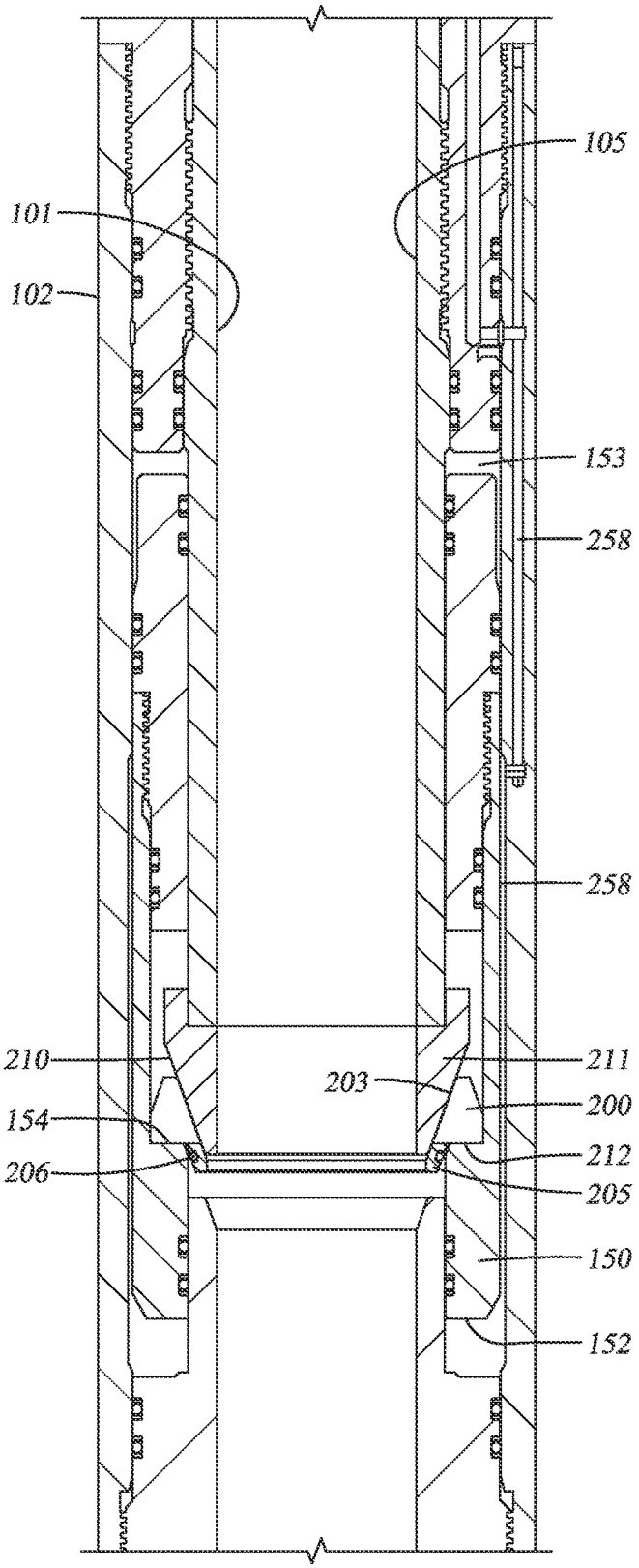
FIG. 10 is a cross section view shown the lower portion of the tool wherein the ball seat has been shifted to an enlarged diameter position.

FIG. 10 is a cross section view showing the lower portion of the tool 100 wherein the ball seat 200 has been shifted to an enlarged diameter position. As shown, the annular shifting piston 150 has moved from a first lower to a second higher position relative to the ball seat due to fluid pressure acting on the piston surface 152 of the piston 150. Consequently, the space 153 has been reduced in volume. In operation, an upwardly facing shoulder 154 of the annular piston 150 that is in contact with a lower surface 212 of the castellations 202 has forced the ball seat 200 with its castellations 202 upwards along the conical surface 210, thereby enlarging the inner diameter of the sealing ring 205 to a size exceeding the outer diameter of the ball 201. In this manner, the ball is released and fluid communication is reestablished between the portions of the bore above and below the ball seat 200.

In one embodiment, the invention is practiced in the following manner: A tool 100 including the ball seat 200 is run into a wellbore in a string of tubulars to a predetermined depth. The ball seat is in its smaller diameter position as shown in FIG. 1, however, the bore through the tool is open because there is no ball in the seat during run in. At some later time, an operator decides to set a pressure-actuated tool, like a packer disposed in the string above the tool 100. A ball is dropped from the surface and lands in the seat as shown in FIG. 1. With the bore of the tool blocked, pressure in the tubular string is increased to a predetermined threshold, typically by pumping from the surface, until the pressure-actuated tool is set. Thereafter, there is a need to remove the ball from the seat and reopen the bore through the tool.

In one embodiment, the ball seat 200 is shifted from its smaller to larger diameter state based upon predetermined parameters consisting of signals to circuitry 125 housed in the tool. Those signals begin as pressure pulses delivered to the tubing pressure transducer 155 from the bore of the tool via aperture 122 (FIG. 3). A complete "pulse" in one instance is a specified pressure applied via the tubing to the tubing pressure transducer followed by a "bleeding off" of that pressure to zero. In one example, the circuitry is programmed to operate the Kevlar fuse of the valve assembly 302 in the event that it receives data from the transducer 155 indicating three separate and distinct pulses have been received. In another example, the data includes not only pulses but pulses separated by a predetermined time delay in seconds or minutes. Additionally, the circuitry can include programming that delays the operation of the fuse for a predetermined period of time after the data has been received. Numerous variations are available limited only by the ability to provide pulses from the bore of the tool to the transducer 155. In one embodiment, an annulus pressure transducer 156 (FIG. 1) is provided. The annulus pressure transducer is in fluid communication with the annulus between the tool 100 and the wellbore walls. By calculating the difference between tubing and annulus pressure, an effective pressure can be determined and that effective pressure data provided to the circuitry for operation of the valve assembly 302 with its Kevlar fuse.

Once conditions for operation of the Kevlar fuse have been met, the electrodes operate to break the retaining members retaining the valve 302 in a closed position and the valve moves from the closed position of FIG. 4 to the open position of FIG. 5. As described in conjunction with FIG. 5, the open valve permits fluid to flow into the fourth fluid path 258 to the annular shifting piston 150, thereby moving the ball seat from the position of FIG. 8 to the position of FIG. 10. With the seat 200 in its larger diameter position, the ball 201 is released, the bore 105 unblocked and wellbore operations can be resumed without having subjected the wellbore and surrounding formations to a pressure surge.

While the foregoing is directed to embodiments of the present invention, other and further embodiments of the invention may be devised without departing from the basic scope thereof, and the scope thereof is determined by the claims that follow.

The invention claimed is:

1. A ball seat apparatus, comprising:

a body, the body for installation in a string of wellbore tubulars, the body having a bore therethrough;

a ball seat disposed in the bore, the seat having a smaller and a larger inner diameter positions, wherein in the smaller inner diameter position the seat is constructed and arranged to retain a ball of a predetermined diameter in a manner whereby the bore of the body is substantially sealed;

an annular area formed in a wall of the body, the annular area including:

a wellbore fluid chamber, the chamber in fluid pressure communication with the bore of the apparatus;

fluid communication between the wellbore fluid chamber and a tubing pressure transducer, the tubing pressure transducer for measuring tubing pressure;

communication between the tubing pressure transducer and a valve assembly, the assembly including a valve, the valve openable upon a predetermined set of pressure values received by the transducer; and selective fluid communication between the valve and an actuator, the actuator including an annular piston constructed and arranged to move the ball seat from the smaller inner diameter to the larger inner diameter position.

2. The apparatus of claim 1, wherein the values include at least two distinct fluid pressure pulses.

3. The apparatus of claim 2, wherein the values further include at least one predetermined time delay between the fluid pressure pulses.

4. The apparatus of claim 2, wherein the values include at least one predetermined time delay after the last pulse in a sequence of fluid pressure pulses.

5. The apparatus of claim 1, further including a hydraulic fluid chamber in pressure communication with the wellbore fluid chamber, the chambers separated by a floating piston.

6. The apparatus of claim 1, wherein the ball seat includes a plurality of castellations connected at a first end to a sealing ring, the sealing ring providing a sealing relationship between the ball seat and the bore and between the ball and the ball seat.

7. The apparatus of claim 6, wherein as the ball seat is moved from the smaller inner diameter to the larger inner diameter position, an inner diameter of the sealing ring is expanded.

8. The apparatus of claim 1, further including an annulus pressure transducer for operation in conjunction with the tubing pressure transducer to provide an effective pressure.

9. The apparatus of claim 1, wherein the valve assembly further includes a Kevlar fuse for operating the valve upon receipt of the predetermined set of values.

10. The apparatus of claim 1, wherein fluid communication within the apparatus is provided by a first, second, third, and fourth fluid paths.

11. A downhole device for shifting a component from a first state to a second state, comprising:

a body, the body having the component in a bore thereof and an annular space formed within an inner and outer walls of the body, the annular space including:

a first fluid chamber, the chamber in fluid communication with the bore at a first location and with a pressure transducer at a second location, the transducer constructed and arranged to measure pressure of the fluid and provide a signal to circuitry controlling a valve upon reception of a predetermined fluid pressure pulse sequence, the pulses generated at a surface of a wellbore;

wherein, when the pressure pulse sequence is delivered, the valve opens, placing a source of pressurized fluid in communication with an actuator that shifts the component from the first to the second state.

12. The device of claim 11, wherein the actuator is an annular piston disposed in the annular area.

13. The device of claim 12, wherein the component is a ball seat and the second state is an open state wherein a passage through the ball seat is enlarged from the first state.

14. A method of setting a pressure actuated tool in a wellbore, comprising:

providing the pressure actuated tool in a string of tubulars;

providing an apparatus in the tubular string below the pressure actuated tool, the apparatus including a ball seat;

dropping a ball into the ball seat, thereby sealing a bore through the apparatus;

increasing pressure in the string above the apparatus;

setting the pressure actuated tool;

providing a predetermined sequence of fluid pressure pulses to the apparatus;

providing a tubing pressure transducer in the apparatus in fluid contact with the fluid pressure pulse sequence;

providing a valve assembly including circuitry in the apparatus whereby the circuitry, upon receipt of the fluid pressure pulse sequence by the transducer, causes a valve in the valve assembly to open and pressurized fluid to pass therethrough;

providing a piston in the apparatus having a piston surface formed thereon for shifting the ball seat from a first smaller diameter position to a second larger diameter position;

placing the piston surface in contact with the pressurized fluid from the open valve;

shifting the ball seat to the second larger diameter position, whereby the ball is released, thereby reopening the bore.

15. The method of claim 14, wherein the pressure actuated tool is a packer.

16. The method of claim 15, wherein the predetermined sequence of fluid pressure pulses is more than two.

17. The method of claim 16, wherein the sequence of fluid pressure pulses includes a predetermined time delay between at least two of the pulses.

* * * * *